United States Patent [19]

Rosen

[11] Patent Number: 5,029,551

[45] Date of Patent: Jul. 9, 1991

[54] SAFETY DEVICE TO INCREASE THE VISIBILITY OF PERSONS AFLOAT IN THE WATER

[76] Inventor: Erik M. Rosen, Box 346, Rock Hill, N.Y. 12775

[21] Appl. No.: 610,547

[22] Filed: Nov. 8, 1990

[51] Int. Cl.[5] ..... B63C 9/20

[52] U.S. Cl. ..... 116/209; 441/89

[58] Field of Search ..... 116/209; 441/89

[56] References Cited

U.S. PATENT DOCUMENTS

| | | | |
|---|---|---|---|
| 827,350 | 7/1906 | Crofford | 441/89 |
| 1,089,522 | 3/1914 | Angell | 116/228 X |
| 4,035,856 | 7/1977 | Oberg | 116/209 X |
| 4,599,965 | 7/1986 | Johnson | 116/209 |

OTHER PUBLICATIONS

Publication-"Skier Buoy", Kids, What Will They Think of Next? Good Housekeeping, Nov. 8, 1990, pp. 1A-14.

*Primary Examiner*—Daniel M. Yasich
*Attorney, Agent, or Firm*—Sandra M. Kotin

[57] ABSTRACT

An automatically activated device to increase the visibility of a person floating in the water which utilizes an inflatable flag assembly lying within a circular housing which is pivotally connected to a plate. Straps threaded through the plate are used to fasten the device to the body. When the wearer enters the water the flag assembly rises through the housing due to its own buoyancy and the banner portion of the flag remains above the head of the wearer. The pivotal connections maintain the flag assembly in the vertical posture even as the wearer bobs in the water.

15 Claims, 2 Drawing Sheets

SAFETY DEVICE TO INCREASE THE VISIBILITY OF PERSONS AFLOAT IN THE WATER

BACKGROUND OF THE INVENTION

FIELD OF INVENTION

Water Sports
Water Safety
Marine Equipment
Safety Equipment

FIELD OF THE INVENTION

The instant invention relates to a safety device to be used by water sports participants to make them more visible and therefore safer in the event that they become cast afloat in the water.

BRIEF SUMMARY OF THE INVENTION

Water sports are becoming increasingly popular, often resulting in the overcrowding of lakes and waterways. The same waterways may be used for pleasure boating, speed boating, water skiing and more recently, motorized water skis. When a water skier goes down, even when wearing the usual life jacket or vest, only his head and a small portion of his shoulders remain above the water surface. Such a person is difficult to see from any distance away and is virtually impossible to spot by the operator of a speeding boat, often until it is too late to avoid a serious accident.

It is the object of the present invention to provide a lightweight, highly visible flag assembly, which when worn by water sports participants, makes them more visible when in the water. It is a further object of the present invention that the flag assembly be self-activating so that the wearer does not have to do anything to raise the flag. It is a further object of this invention to maintain the posture of the flag assembly in a vertical position even as the wearer changes attitude as he bobs in the water.

The present invention consists of a flag assembly worn by the water skier or other water sports participant attached to his back. The flag assembly rests low against the back until the wearer enters the water. At this point, the flag assembly, by means of its own buoyancy, is propelled upward by the water and remains extended above the wearer's head, thus increasing his visibility. Not only will the wearer have a better chance of being seen by operators of oncoming boats, but his own crew will have an easier time locating him in the water, making for a more efficient recovery. The warning flag will appear to the operator of an oncoming vessel much as a buoy or channel marker.

The device consists of a flag assembly, a housing in which the shaft of the flag assembly loosely rests, a connecting bar pivotally joined to the housing at one end and likewise pivotally joined to a flat plate at the other end. The device is thereafter fastened to the body by means of straps through apertures in the plate.

DETAILED DESCRIPTION OF THE INVENTION

Figure 1:
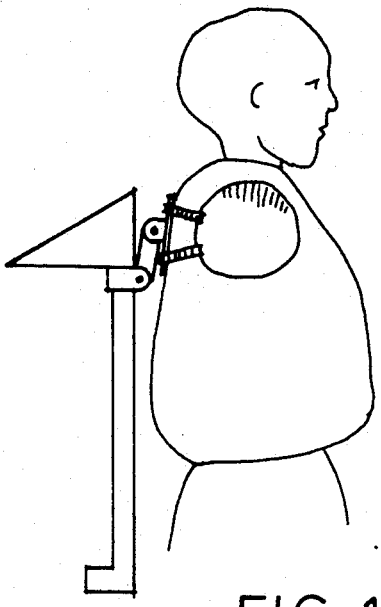
FIG. 1, is a side view of the device as worn by a person before entering the water.
Figure 2:
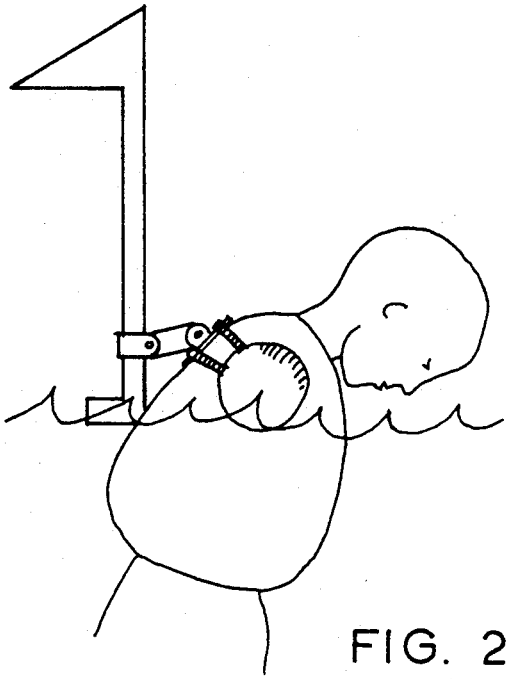
FIG. 2, is a side view of the device after the wearer enters the water, showing the position of the flag assembly as the wearer moves forward.
Figure 3:
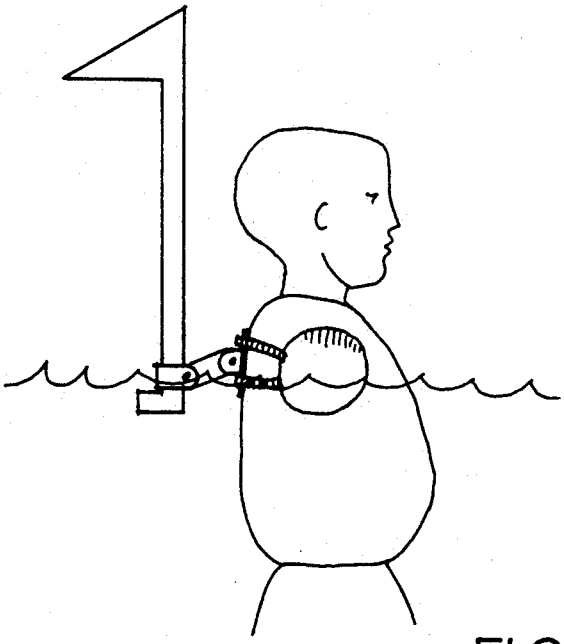
FIG. 3, is a side view of the device after the wearer enters the water showing the position of the flag assembly as the wearer remains upright.
Figure 4:
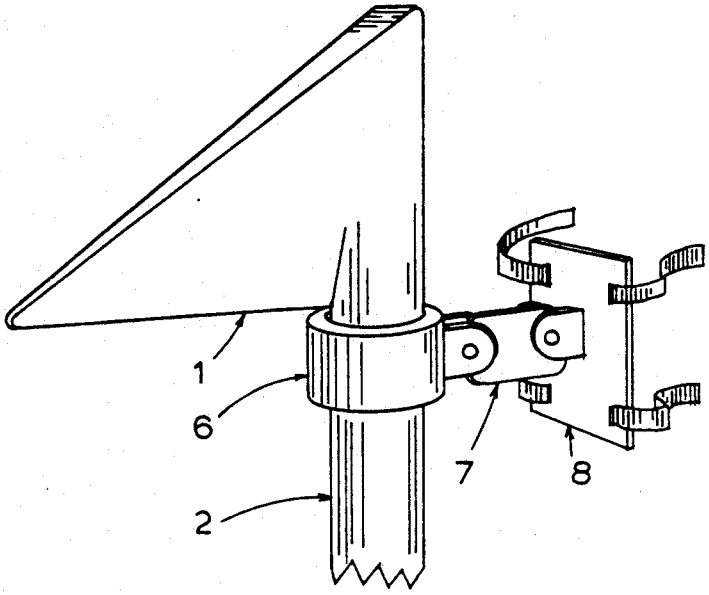
FIG. 4, is a view of the flag assembly, housing, connecting bar and plate.
Figure 5:
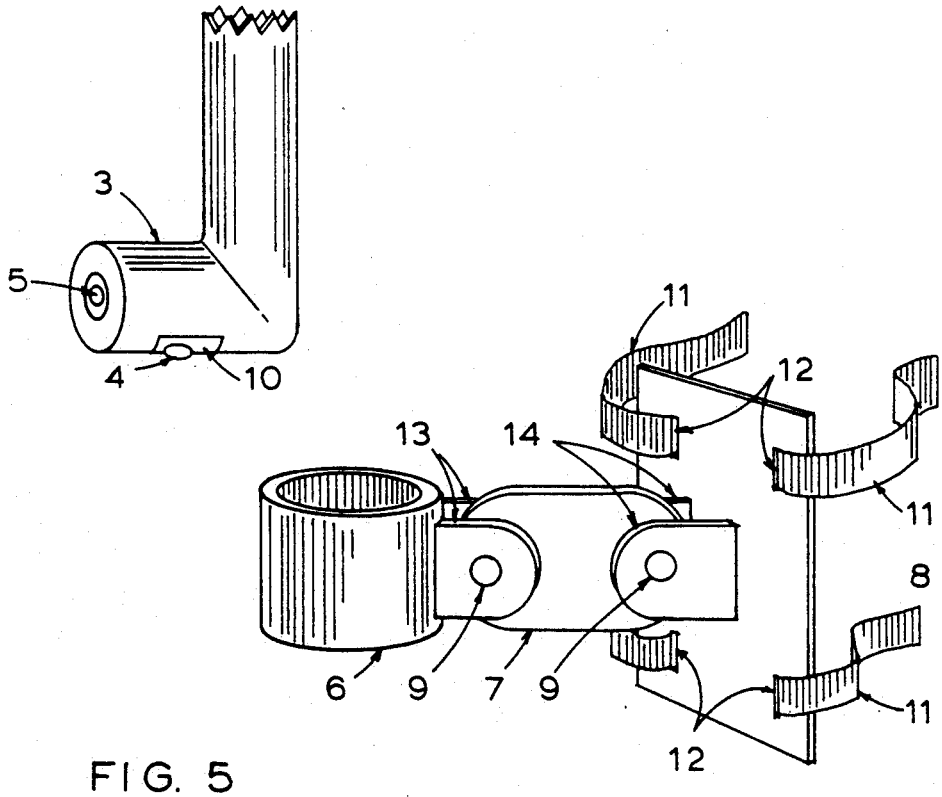
FIG. 5, is a detailed view of the housing, connecting bar, plate and fastening straps.

The present invention embodies an inflatable flag assembly having a banner portion 1, a shaft portion 2 and a base portion 3. The base portion 3 contains a pocket 10 holding a weight 4 and a valve 5 as means to inflate the flag assembly. The whole flag assembly is made in one unit. The shaft portion 2 lies within a circular housing 6 having two parallel projections 13 through which fit one end of a rectangular connecting bar 7. The other end of the connecting bar 7 fits between two parallel projections 14 from a flat plate 8. The two connecting points are pivotal by means of rivets 9. The device is affixed to the wearer by means of straps 11 through apertures 12 in plate 8.

The flag assembly is constructed of inflatable plastic or rubber film whereby the banner 1, shaft 2 and base 3 portions are all one inflated unit. In effect, a balloon in the shape of a flag. This construction provides a very buoyant unit which will be propelled upward when the wearer enters the water. As long as the diameter of housing 6 is larger than the diameter of the shaft portion 2, and the banner portion 1 and base portion 3 extend beyond the shaft portion 2, the flag assembly can rise in the water by its own buoyancy. The wearer does not have to activate it in any way. This is an added advantage should the wearer become incapacitated or unconscious.

A person floating in the water generally moves in a front-to-back bobbing fashion. To compensate for this type of motion, the housing 6 is connected pivotally to the bar 7 which is in turn connected pivotally to the plate 8. As the wearer bobs forward and back, the pivot points (rivets 9) maintain the flag assembly in a vertical posture.

When the wearer is not in the water, the flag assembly slips or is guided downward through the housing 6 and lies against the body. The nature of the flag assembly prevents any awkward slapping of the flag against the back of the wearer. The pivotal connections allow the flag assembly to lie close to the body.

A small weight 4 is attached to the base portion 3 of the flag assembly by means of a small pocket 10. This weight is made of a water impervious material with specific gravity greater than 1.0. This weight 4 serves to keep the flag assembly low and against the body when the wearer is out of the water, and will act as ballast when the wearer enters the water and the flag assembly rises and remains vertical. The pocket 10 is built into the plastic or rubber film at its manufacture. The rigidity of the flag assembly is maintained by the inflation of the unit with sufficient air.

A means to inflate the flag assembly is also present in the base portion 3. This valve 5 may be one for mechanical inflation or inflation by mouth. Such inflation valves are well known in the art. The flag assembly may be deflated for easy storage when not in use.

The inflatable plastic or rubber films used to make the flag assembly are the same as those used in the manufacture of children's swim tubes and beach balls. Such materials are well known in the art.

No rigid member is made a part of the flag assembly. This is intentional. The flag assembly maintains its own rigidity when properly inflated. Thus, the absence of a rigid member in the inflated flag assembly reduces the risk of injury to the wearer. The flag assembly is less apt to poke, strike or bother the wearer.

The entire flag assembly should be one color, preferably Orange to correspond to Coast Guard regulations of safety and to enhance visibility.

The flag assembly may be made in various lengths so as to be properly fitted to persons of different heights. It may be worn directly on the body or over a conventional life vest or life jacket.

I claim:

1. A safety device to increase the visibility of a person afloat in the water which comprises a buoyant flag assembly which can be affixed by a housing means to the human body and which rises automatically and is guided through the housing means as the flag assembly rises above the head of the wearer when the wearer enters the water.

2. A safety devise to increase the visibility of a person afloat in the water which comprises:

(a) a buoyant flag assembly, the shaft of which is positioned within (b) a circular housing from which extend two parallel projections through which is pivotally connected one end of (c) a rectangular rigid bar, the other end of which is likewise pivotally connected through two parallel projections protruding from and permanently affixed to (d) a flat plate, said plate containing (e) means for attachment to the human body.

3. A device as set forth in claim 2, wherein the buoyant flag assembly is constructed of inflatable plastic film.

4. A devise as set forth in claim 2, wherein the buoyant flag assembly is constructed of inflatable rubber film.

5. A device as set forth in claim 2, wherein the buoyant flag assembly is constructed in different sizes to accommodate persons of different heights.

6. A device as set forth in claim 2, wherein the banner, shaft and base portions of the flag assembly are constructed in one unit whereby the banner portion and base portion extend beyond the shaft such that the flag assembly cannot slip through the housing at either end.

7. A flag assembly as set forth in claim 2, wherein the banner portion may be in any geometric shape as long as its diameter is larger than that of the shaft.

8. A flag assembly as set forth in claim 2, which is Orange in color.

9. A flag assembly as set forth in claim 2, wherein a means to inflate the unit is present in the base.

10. A flag assembly as set forth in claim 2, wherein a small weight is affixed to the base portion.

11. A weight as set forth in claim 10, which is composed of a water impervious material having a specific gravity greater than 1.0.

12. A flag assembly as set forth in claim 2, wherein a pocket is built into the base portion such that a small weight may be contained therein.

13. A device as set forth in claim 2, wherein the diameter of the circular housing is greater than the diameter of the shaft of the flag assembly such that the said shaft can move freely through it.

14. A device as set forth in claim 2, wherein the pivot points are maintained by means of rivets.

15. A device as set forth in claim 2, wherein the said device is attached to the human body by means of straps threaded through apertures in the flat plate.

* * * * *